US008746365B2

(12) United States Patent
Gutsol

(10) Patent No.: US 8,746,365 B2
(45) Date of Patent: Jun. 10, 2014

(54) ELECTRO-HYDRAULIC DRILLING WITH SHOCK WAVE REFLECTION

(75) Inventor: Alexander F. Gutsol, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 200 days.

(21) Appl. No.: 13/252,085

(22) Filed: Oct. 3, 2011

(65) Prior Publication Data

US 2013/0081874 A1 Apr. 4, 2013

(51) Int. Cl.
*E21B 7/15* (2006.01)
*E21B 7/00* (2006.01)

(52) U.S. Cl.
USPC ..... 175/1; 175/16; 175/104

(58) Field of Classification Search
USPC ..... 175/1, 16, 104
See application file for complete search history.

(56) References Cited

U.S. PATENT DOCUMENTS 3,500,942 A * 3/1970 Smith, Jr. ..... 175/16
3,840,270 A * 10/1974 Allgood ..... 299/14
4,597,388 A * 7/1986 Koziol et al. ..... 607/27
4,696,299 A * 9/1987 Shene et al. ..... 601/4

OTHER PUBLICATIONS

International Preliminary Report on Patentability in PCT/US2012/0584446, mailed Sep. 6, 2013, 5 pages.

* cited by examiner

*Primary Examiner* — Giovanna Wright
(74) *Attorney, Agent, or Firm* — Pillsbury Winthrop Shaw Pittman, LLP

(57) ABSTRACT

Shock waves produced during electro-hydraulic drilling can be reflected into a rock body where the reflected shock waves are converted from compression waves to tension waves, which are more efficient at breaking down the rock body. A system configured for electro-hydraulic drilling where shock waves produced during drilling are reflected into the rock body includes two electrodes and a shock wave reflector disposed at an electro-hydraulic drill head. The two electrodes are configured to (1) facilitate formation of a spark along a spark path spanning the two electrodes and (2) facilitate a pulse of electricity being passed through the spark to form a primary shock wave emanating from the spark path. The shock wave reflector is configured to reflect a portion of the primary shock wave such that the reflected shock wave is concentrated to a focal region within the rock body.

16 Claims, 3 Drawing Sheets

ELECTRO-HYDRAULIC DRILLING WITH SHOCK WAVE REFLECTION

FIELD OF THE DISCLOSURE

This disclosure relates to reflecting shock waves produced during electro-hydraulic drilling such that the reflected shock waves are concentrated to a focal region.

BACKGROUND

Electro-hydraulic drilling is known. By way of non-limiting example, electro-hydraulic drilling may be implemented while drilling productions wells used to extract gas, oil, water, and/or other materials from the Earth. In existing approaches, an electrical spark is typically created between electrodes at a drill head. A pulse of electricity at high peak power is then passed through the spark. This forms a rapidly expanding plasma that creates a shock wave. These shock waves can be so powerful they can crush rock. Such a shock wave can be controlled to crush the rock within a rock body just ahead of the drill head to less than one millimeter in size. Typically, shock waves are repeated ten to fifty times per second to drill into the rock body.

A fluid (e.g., water, mud, and/or other fluid) is often used to remove rock debris above the rock body. The fluid surrounds the drill head and flushes out rock particles. In existing approaches to electro-hydraulic drilling, a significant number of electrical sparks form only or primarily in the fluid, rather than extending into the rock body. Shock waves that emanate from electrical sparks within the rock body are tension waves. When the electrical spark forms only within the fluid, resulting shock waves are compression waves. Tension waves are more efficient at breaking up the rock body, relative to compression waves.

SUMMARY

One aspect of the disclosure relates to a system configured for electro-hydraulic drilling where shock waves produced during drilling are reflected into a rock body. The system includes two electrodes and a shock wave reflector disposed at an electro-hydraulic drill head. The two electrodes are configured to (1) facilitate formation of a spark along a spark path spanning the two electrodes and (2) facilitate a pulse of electricity being passed through the spark to form a primary shock wave emanating from the spark path. The shock wave reflector is configured to reflect a portion of the primary shock wave that emanated from the spark path such that the reflected shock wave is concentrated to a focal region within the rock body. The reflected shock wave is converted from a compression wave to a tension wave when the reflected shock wave propagates beyond the focal region.

Another aspect of the disclosure relates to an apparatus configured to reflect shock waves into a rock body during electro-hydraulic drilling. The apparatus includes a shock wave reflector configured to be disposed at an electro-hydraulic drill head, the electro-hydraulic drill head having two electrodes disposed thereat. The two electrodes are configured to (1) facilitate formation of a spark along a spark path spanning the two electrodes and (2) facilitate a pulse of electricity being passed through the spark to form a primary shock wave emanating from the spark path. The shock wave reflector is configured to reflect a portion of the primary shock wave that emanated from the spark path such that the reflected shock wave is concentrated to a focal region within the rock body. The reflected shock wave is converted from a compression wave to a tension wave when the reflected shock wave propagates beyond the focal region.

Yet another aspect of the disclosure relates to a method for reflecting shock waves into a rock body during electro-hydraulic drilling. The method includes forming a spark between two electrodes disposed at an electro-hydraulic drill head. The spark follows a spark path spanning the two electrodes. The method includes passing a pulse of electricity through the spark to form a primary shock wave emanating from the spark path. The method includes reflecting a portion of the primary shock wave that emanated from the spark path such that the reflected shock wave is concentrated to a focal region within the rock body. The reflected shock wave is converted from a compression wave to a tension wave when the reflected shock wave propagates beyond the focal region.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the technology. As used in the specification and in the claims, the singular form of "a", "an", and "the" include plural referents unless the context clearly dictates otherwise.

DETAILED DESCRIPTION

Figure 1:
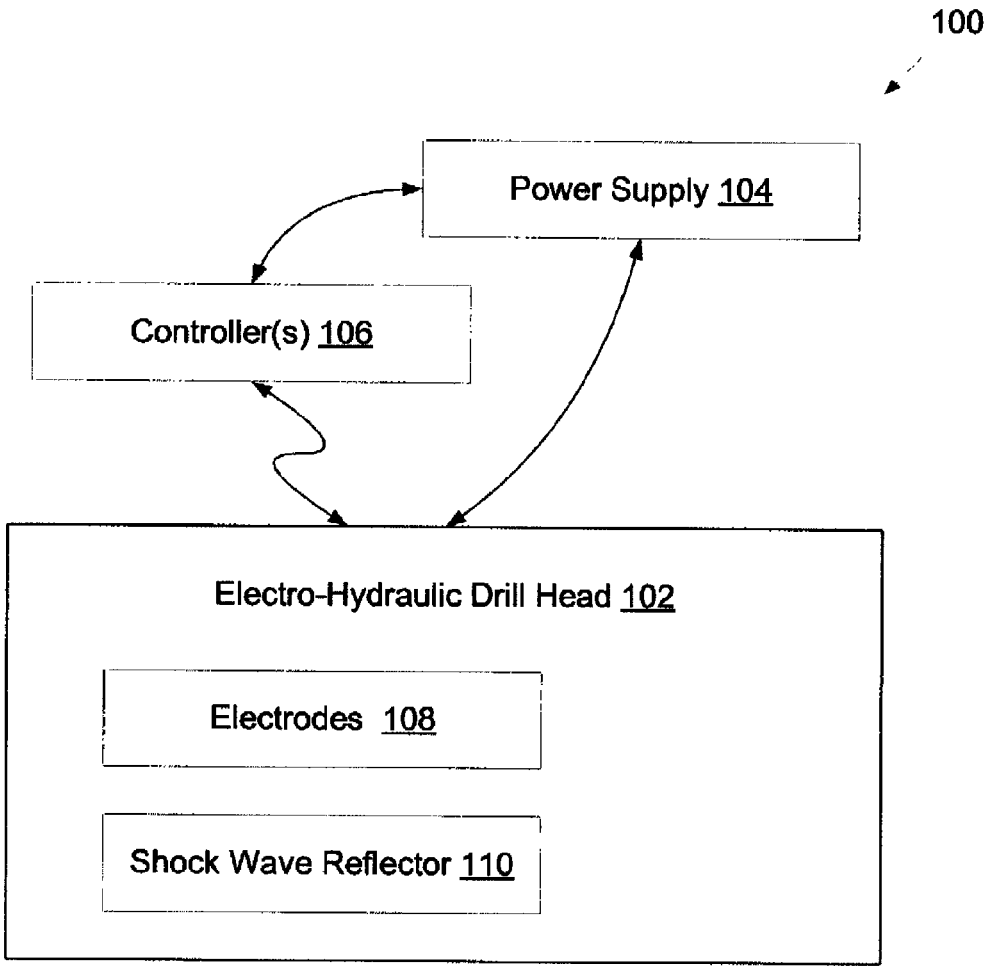
FIG. 1 illustrates a system configured for electro-hydraulic drilling where shock waves produced during drilling are reflected into a rock body, in accordance with one or more embodiments.

FIG. 1 illustrates a system 100 configured for electro-hydraulic drilling where shock waves produced during drilling are reflected into a rock body, in accordance with one or more embodiments. In some embodiments, a shock wave reflector is used to reflect shock waves into the rock body. Reflected shock waves can be concentrated to a focal region within the rock body. As reflected shock waves propagate beyond the focal region, the reflected shock waves are converted from compression waves to tension waves. By introducing tension waves into the rock body, drilling efficiency may be enhanced.

As depicted in FIG. 1, system 100 may include one or more of an electro-hydraulic drill head 102, a power supply 104, one or more controllers 106, and/or other components. One or more components of system 100 may be communicatively coupled and/or electrically coupled. The depiction of system 100 in FIG. 1 is not intended to be limiting as system 100 may include more or less components than those shown. Additionally, two or more components may be combined as singular components.

The electro-hydraulic drill head 102 is configured to drill through a rock body by creating shock waves that destroy the rock body proximate to electro-hydraulic drill head 102. As depicted in FIG. 1, electro-hydraulic drill head 102 includes electrodes 108, a shock wave reflector 110, and/or other components. The depiction of electro-hydraulic drill head 102 in FIG. 1 is not intended to be limiting as electro-hydraulic drill head 102 may include more or less components than those shown. Additionally, two or more components may be combined as singular components. Exemplary embodiments of electrodes 108 and shock wave reflector 110 are described in connection with FIGS. 2A and 2B.

The power supply 104 is configured to provide electrical power to one or more components of system 100. The power supply 104 may include one or more of a generator, a power plant, a battery, and/or other sources of electrical power. The electrical power provided by power supply 104 may include alternating current, direct current, pulses of current, and/or other forms of electrical power.

The controller(s) 106 is configured to control one or more components of system 100. In some embodiments, controller 106 may include one or more processors (not depicted) configured to execute computer software modules, electronic storage (not depicted) configured to store information received from or used by the one or more processors, and/or other components facilitating functionalities of controller 106 described herein. In some embodiments, controller(s) 106 communicates wirelessly with one or more components of system 100. In embodiments where controller(s) 106 includes more than one controller, those controllers may be collocated or may be disparately located operating in concert. Various functions of controller(s) 106 are discussed in further detail herein.

Figures 2A, 2B:
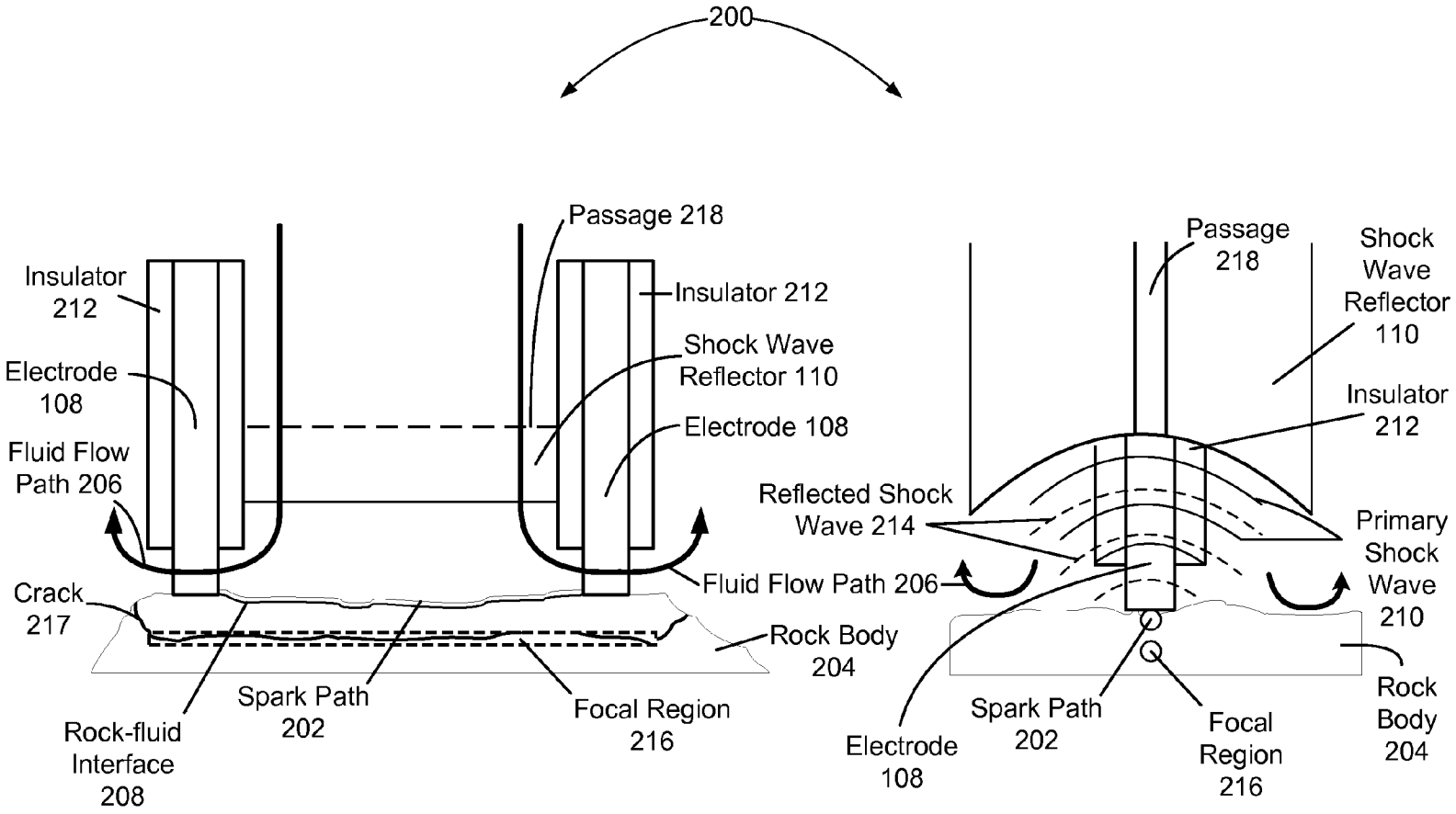
FIGS. 2A and 2B illustrate a configuration for electrodes and a shock wave reflector disposed at an electro-hydraulic drill head, in accordance with one or more embodiments.

FIGS. 2A and 2B illustrate a configuration 200 for electrodes 108 and shock wave reflector 110 disposed at electro-hydraulic drill head 102, in accordance with one or more embodiments. The views of configuration 200 depicted in FIGS. 2A and 2B are orthogonal. The depiction of configuration 200 in FIGS. 2A and 2B is not intended to be limiting as configuration 200 may include more or less components than those shown. Additionally, two or more components may be combined as singular components.

The electrodes 108 are configured to facilitate formation of a spark along a spark path 202 spanning electrodes 108. While drilling, electrodes 108 are positioned in contact with or near a rock body 204. In some embodiments, electrical power from power supply 104 is supplied to electrodes 108 in order to form the spark. A fluid (e.g., water, mud, and/or other fluid) may be used to remove rock debris above rock body 204. The fluid is used to flush out rock particles by flowing between electrodes 108 and out of the drill head, as shown by fluid flow path 206, in accordance with some embodiments. Oftentimes, spark path 202 may lie at or proximate to a rock-fluid interface 208 between the fluid and rock body 204.

The electrodes 108 are configured to facilitate a pulse of electricity being passed through the spark. In some embodiments, electrical power from power supply 104 is supplied to electrodes 108 in order to provide the pulse of electricity. The pulse of electricity can form rapidly expanding plasma in the fluid, which, in turn, creates a primary shock wave 210 emanating from spark path 202. A portion of primary shock wave 210 propagates away from rock body 204.

The electrodes 108 are partially encapsulated by an insulator 212, in some embodiments. The insulator 212 is configured to electrically isolate some or all of electrodes 108 from an environment surrounding electro-hydraulic drill head 102. While FIG. 2A shows two electrodes 108, this is not intended to be limiting as configuration 200 may include two or more electrodes that are the same or similar to electrodes 108.

The shock wave reflector 110 is configured to be disposed at electro-hydraulic drill head 102. According to some embodiments, at least a portion of shock wave reflector 110 is be disposed between electrodes 108. In some embodiments, at least a portion of shock wave reflector 110 is disposed outside of the space between electrodes 108. It is appreciated that shock wave reflector 110, in accordance with various embodiments, includes and/or is formed by one or more individual components. For example, in some embodiments, a portion of shock wave reflector 110 is integrated with electro-hydraulic drill head 102.

The shock wave reflector 110 is configured to reflect a portion of primary shock wave 210 that emanated from spark path 202 such that a reflected shock wave 214 is concentrated to a focal region 216 within rock body 204. According to some embodiments, focal region 216 is positioned away from rock-fluid interface 208 (within rock body 204) by a distance of approximately 0.1-1 centimeters. Generally speaking, the depth of focal region 216 within rock body 204 depends on the distance between electrodes 108 (i.e., the inter-electrode distance, L) such that the depth is greater than about L/200 and less than about L/2. The reflected shock wave 214 is converted from a compression wave to a tension wave when reflected shock wave 214 propagates beyond focal region 216. This may effectuate a crack 217 and/or other damage to rock body 204 at or proximate to focal region 216. Because rock material is weaker when subjected to tension waves, compared to compression waves, drilling efficiency can be enhanced.

In some embodiments, at least a portion of shock wave reflector 110 is shaped as a portion of a cylinder. In such embodiments, shock wave reflector 110 may be formed and/or positioned such that a longitudinal symmetry axis of the cylinder is disposed beyond the ends of electrodes 108. When electrodes 108 are placed in contact with or near rock body 204, the longitudinal symmetry axis of the cylinder is positioned within rock body 204. The primary shock wave 210 is reflected by shock wave reflector 110 such that reflected shock wave 214 is concentrated along, proximate to, or beyond the longitudinal symmetry axis of the cylinder.

In some existing approaches to electro-hydraulic drilling, it has been observed that regions of a rock body just below the electrodes have the slowest rate of destruction compared to other area under an electro-hydraulic drill head. According to some embodiments, shock wave reflector 110 is shaped so as to concentrate more of reflected shock wave 214 to portions of focal region 216 proximate to each of electrodes 108 relative to a midpoint between electrodes 108. This may provide a more even rock-destruction rate across rock-fluid interface 208.

It may be possible, in some implementations, that energy provided by reflected shock wave 214 alone is insufficient to destroy rock body 204 proximate to rock-fluid interface 208. The reflected shock wave 214 can be temporally coordinated with a subsequent spark and/or a subsequent primary shock wave emanating from the spark path. In some embodiments, such temporal coordination may allow energy from reflected shock wave 214 to combine with energy from the subsequent primary shock wave. The temporal coordination may facilitate formation of a spark inside rock body 204 along focal region 216 of reflected shock wave 214. The temporal coordination may be achieved by adjusting a time interval between primary shock waves, by adjusting the position of shock wave reflector 110 relative to spark path 202, by adjusting the shape of shock wave reflector 110, and/or by other techniques for temporal coordination. In some embodiments, controller(s) 106 is configured to facilitate temporal coordination between reflected shock wave 214 and a subsequent primary shock wave.

The shock wave reflector 110 may include one or more passages 218. The passage(s) 218 may include one or more of holes, slots, and/or other passages through shock wave reflector 110. The electro-hydraulic drill head 102 may include one or more passages in fluid communication with passage(s) 218 of shock wave reflector 110. The passage(s) 218 may be configured to allow fluid and/or particulate communication through shock wave reflector 110. In some embodiments, a fluid (e.g., water, mud, and/or other fluid) used to remove rock debris above rock body 204 may pass though passage(s) 218. This may prevent rock particles from accumulating between shock wave reflector 110 and rock body 204.

Figure 3:
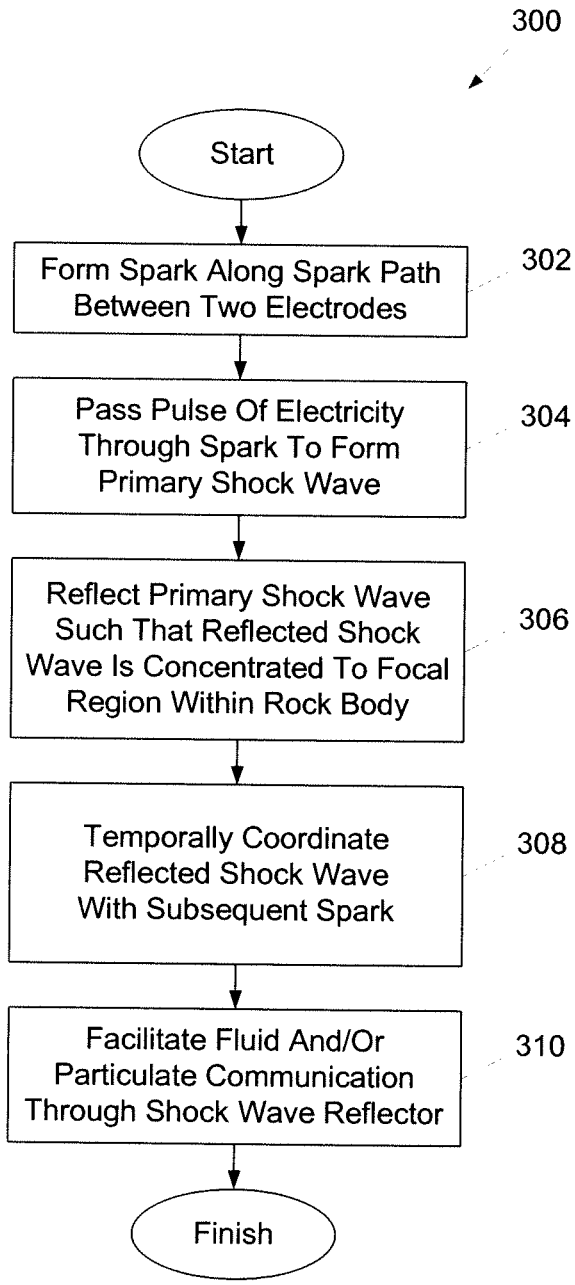
FIG. 3 illustrates a method for reflecting shock waves produced during electro-hydraulic drilling into a rock body, in accordance with one or more embodiments.

FIG. 3 illustrates a method 300 for reflecting shock waves produced during electro-hydraulic drilling into a rock body, in accordance with one or more embodiments. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. For example, two or more operations of method 300 may be performed concurrently. As another example, one or more operations of method 300 may be performed continuously during execution of all or part of method 300.

In some embodiments, one or more operations of method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on an electronic storage medium. The one or more processing devices may include one or more devices configured through hardware, firmware, and/or software to be specifically designed for execution of one or more of the operations of method 300.

At operation 302, a spark is formed between two electrodes disposed at an electro-hydraulic drill head such that the spark follows a spark path spanning the two electrodes. For operation 302, electrical power from power supply 104 is supplied to electrodes 108 in order to form the spark, in accordance with some embodiments.

At operation 304, a pulse of electricity is passed through the spark to form a primary shock wave emanating from the spark path. For operation 304, in some embodiments, electrical power from power supply 104 is supplied to electrodes 108 in order to provide the pulse of electricity. The pulse of electricity can form rapidly expanding plasma in the fluid, which, in turn, creates a primary shock wave 210 emanating from spark path 202.

At operation 306, a portion of the primary shock wave that emanated from the spark path is reflected such that the reflected shock wave is concentrated to a focal region within a rock body. The reflected shock wave is converted from a compression wave to a tension wave when the reflected shock wave propagates beyond the focal region. For operation 306, in some embodiments, reflecting the portion of the primary shock wave is performed using a shock wave reflector (e.g., shock wave reflector 110). A portion of the shock wave reflector may be shaped as a portion of a cylinder. The shock wave reflector may be shaped so as to concentrate more of the reflected shock wave to the focal region proximate to each of the two electrodes relative to a midpoint between the two electrodes.

At operation 308, the reflected shock wave is temporally coordinated with a subsequent spark formation. For operation 308, in some embodiments, the temporal coordination may be achieved by adjusting a time interval between successive sparks, by adjusting the position of shock wave reflector 110 relative to spark path 202, by adjusting the shape of shock wave reflector 110, and/or by other techniques for temporal coordination. In some embodiments, controller(s) 106 is configured to facilitate temporal coordination between reflected shock wave 214 and a subsequent spark formation.

At operation 310, fluid and/or particulate communication is facilitated through one or more passages through the shock wave reflector. For operation 310, passage(s) 218 included in shock wave reflector 110 may facilitate such fluid and/or particulate communication through shock wave reflector 110, in accordance with some embodiments.

Although the technology has been described in detail for the purpose of illustration based on what is currently considered to be the most practical and preferred embodiments, it is to be understood that such detail is solely for that purpose and that the technology is not limited to the disclosed embodiments, but, on the contrary, is intended to cover modifications and equivalent arrangements that are within the spirit and scope of the appended claims. For example, it is to be understood that the present technology contemplates that, to the extent possible, one or more features of any embodiment can be combined with one or more features of any other embodiment.

What is claimed is:

1. A system configured for electro-hydraulic drilling where shock waves produced during drilling are reflected into a rock body, the system comprising:

two electrodes disposed at an electro-hydraulic drill head, the two electrodes being configured to (1) facilitate formation of a spark along a spark path spanning the two electrodes and (2) facilitate a pulse of electricity being passed through the spark to form a primary shock wave emanating from the spark path; and a shock wave reflector disposed at the electro-hydraulic drill head, the shock wave reflector being configured to reflect a portion of the primary shock wave that emanated from the spark path such that the reflected shock wave is concentrated to a focal region within the rock body, the reflected shock wave being converted from a compression wave to a tension wave when the reflected shock wave propagates beyond the focal region.

2. The system of claim 1, wherein a portion of the shock wave reflector is shaped as a portion of a cylinder.

3. The system of claim 1, wherein the reflected shock wave is temporally coordinated with a subsequent spark.

4. The system of claim 1, wherein the shock wave reflector is shaped so as to concentrate more of the reflected shock wave to the focal region proximate to each of the two electrodes relative to a midpoint between the two electrodes.

5. The system of claim 1, wherein the shock wave reflector includes one or more passages through the shock wave reflector, the one or more passages being configured to allow fluid and/or particulate communication through the shock wave reflector.

6. An apparatus configured to reflect shock waves into a rock body during electro-hydraulic drilling, the apparatus comprising:

a shock wave reflector disposed at an electro-hydraulic drill head, the electro-hydraulic drill head having two electrodes disposed thereat, the two electrodes being configured to (1) facilitate formation of a spark along a spark path spanning the two electrodes and (2) facilitate a pulse of electricity being passed through the spark to form a primary shock wave emanating from the spark path, wherein the shock wave reflector is reflects a portion of the primary shock wave that emanated from the spark path such that the reflected shock wave is concentrated to a focal region within the rock body, the reflected shock wave being converted from a compression wave to a tension wave when the reflected shock wave propagates beyond the focal region.

7. The apparatus of claim 6, wherein a portion of the shock wave reflector is shaped as a portion of a cylinder.

8. The apparatus of claim 6, wherein the reflected shock wave is temporally coordinated with a subsequent spark.

9. The apparatus of claim 6, wherein the shock wave reflector is shaped so as to concentrate more of the reflected shock wave to the focal region proximate to each of the two electrodes relative to a midpoint between the two electrodes.

10. The apparatus of claim 6, wherein the shock wave reflector includes one or more passages through the shock wave reflector, the one or more passages being configured to allow fluid and/or particulate communication through the shock wave reflector.

11. A method for reflecting shock waves into a rock body during electro-hydraulic drilling, the method comprising:

forming a spark between two electrodes disposed at an electro-hydraulic drill head, the spark following a spark path spanning the two electrodes;

passing a pulse of electricity through the spark to form a primary shock wave emanating from the spark path; and reflecting a portion of the primary shock wave that emanated from the spark path such that the reflected shock wave is concentrated to a focal region within the rock body, the reflected shock wave being converted from a compression wave to a tension wave when the reflected shock wave propagates beyond the focal region.

12. The method of claim 11, further comprising temporally coordinating the reflected shock wave with a subsequent spark.

13. The method of claim 11, wherein reflecting the portion of the primary shock wave is performed using a shock wave reflector.

14. The method of claim 13, wherein a portion of the shock wave reflector is shaped as a portion of a cylinder.

15. The method of claim 13, wherein the shock wave reflector is shaped so as to concentrate more of the reflected shock wave to the focal region proximate to each of the two electrodes relative to a midpoint between the two electrodes.

16. The method of claim 13, further comprising facilitating fluid and/or particulate communication through one or more passages through the shock wave reflector.

* * * * *